US005719111A

United States Patent [19]

van den Brom et al.

[11] Patent Number: 5,719,111

[45] Date of Patent: Feb. 17, 1998

[54] PROCESS FOR PREPARING A SOLID DETERGENT BLOCK

[75] Inventors: Guido Clemens van den Brom, Maarssen; Seeng Djiang Liem, Rhoon; Harmannus Tammes, Vlaardingen, all of Netherlands

[73] Assignee: Lever Brothers Company, Division of Conopco, Inc., New York, N.Y.

[21] Appl. No.: 601,937

[22] Filed: Feb. 15, 1996

[30] Foreign Application Priority Data

Feb. 17, 1995 [EP] European Pat. Off. ..... 95200381

[51] Int. Cl.[6] ..... C11D 11/00

[52] U.S. Cl. ..... 510/224; 510/229; 510/446; 510/480; 510/505; 510/511

[58] Field of Search ..... 510/224, 229, 510/446, 480, 511, 505

[56] References Cited

U.S. PATENT DOCUMENTS

| | | | |
|---|---|---|---|
| 2,371,720 | 3/1945 | Stine | 299/83 |
| 2,382,163 | 8/1945 | MacMahon | 252/138 |
| 2,382,164 | 8/1945 | MacMahon | 252/138 |
| 2,382,165 | 8/1945 | MacMahon | 252/135 |
| 4,397,757 | 8/1983 | Bright et al. | 252/186.41 |
| 4,751,015 | 6/1988 | Humphreys et al. | 252/99 |
| 5,358,655 | 10/1994 | Kruse et al. | 510/224 |
| 5,366,654 | 11/1994 | van den Brom et al. | 510/224 |
| 5,382,377 | 1/1995 | Raehse et al. | 252/174 |
| 5,382,379 | 1/1995 | Raehse et al. | 510/446 |
| 5,518,646 | 5/1996 | van den Brom | 510/224 |

FOREIGN PATENT DOCUMENTS

| | | |
|---|---|---|
| 0 003 769 | 9/1979 | European Pat. Off. . |
| 0 244 153 | 11/1987 | European Pat. Off. . |
| 0 331 229 | 9/1989 | European Pat. Off. . |
| 0 375 022 | 6/1990 | European Pat. Off. . |
| 0 446 982 | 9/1991 | European Pat. Off. . |
| 0 453 003 | 10/1991 | European Pat. Off. . |
| 0 466 484 | 1/1992 | European Pat. Off. . |
| 0504091 | 9/1992 | European Pat. Off. . |
| 0 284 292 | 10/1994 | European Pat. Off. . |
| WO 90/02165 | 3/1990 | WIPO . |
| 9115568 | 10/1991 | WIPO . |
| WO 91/15567 | 10/1991 | WIPO . |
| WO 94/23010 | 10/1994 | WIPO . |

*Primary Examiner*—Douglas J. McGinty
*Assistant Examiner*—Lorna M. Douyon
*Attorney, Agent, or Firm*—A. Kate Huffman

[57] ABSTRACT

A detergent block of compressed granular material is provided, said block having a weight of 0.2–10 kg, being substantially free of phoshate builder material, and comprising a granulated builder material, an alkaline agent and a compressing aid. A process is also provided for preparing a block of compressed granular material being substantially free of a phosphate builder and having a weight of 0.2 to 10 kg, said process involving the steps of (i) granulating a non-phosphate builder material, with 0.1–10% by weight based on the weight of the builder of a co-ingredient selected from polycarboxylic polymer solutions, alkali metal silicate solutions, and mixtures thereof;and (ii) compressing a particulate mixture of said granulated builder material and other components of the block, including a compressing aid, in a mould under a pressure of 3–30 kN/cm$^2$.

6 Claims, No Drawings

PROCESS FOR PREPARING A SOLID DETERGENT BLOCK

FIELD OF THE INVENTION

The present invention relates to a solid detergent block for obtaining an aqueous chemical solution having a substantially constant concentration. The invention also relates to a process for preparing such a block. Such detergent blocks are suitable for use in an industrial cleaning process, particularly a mechanical warewashing process and generally comprise alkaline agents and detergency builders.

BACKGROUND OF THE INVENTION

Industrial ware washing machines generally comprise a wash tank which contains the cleaning solution for the wash process. In this process, the soiled wash load is doused with the cleaning solution and subsequently with rinse water which falls into the wash tank. Each cycle, the cleaning power of the cleaning liquor is reduced, first because some is exhausted by the soil-removing process and, secondly, because it is diluted with rinse water. The cleaning solution is therefore recharged from time to time by adding fresh cleaning product from a dispenser system, which usually provides liquid product or a concentrated aqueous solution of a composition including solid chemicals.

A number of techniques are known for converting solid chemicals into a concentrated solution, dependent on the nature of the solid. For example, according to U.S. Pat. No. 2,371,720 a solid powdered chemical can be dissolved by placing it on a sieve and spraying water on to said sieve from below.

Alternatively, the powdered material can be dissolved in a dispenser of the "water-in-reservoir" type. In this type of dispenser, the powdered material is submerged under water, which therefore becomes loaded or even saturated with the powder. When more water is added, the excess solution flows into an overflow pipe leading to the washing machine.

It is also possible to use solid detergent materials in the form of briquettes such as, for instance, described in U.S. Pat. No. 2,382,163, 2,382,164 and 2,382,165. Briquettes can be used with a "water-in-reservoir" type of dispenser.

A well-known type of solid detergent is the cast block form, whereby a solid detergent block having a weight of several kilograms is formed by pouring a concentrated aqueous slurry into a container, in which it solidifies upon cooling as a result of the hydration of the salts in the composition. Such cast solid blocks are, for example, described in European patent 3,769.

These solid blocks cast in containers require dispensing systems whereby water is sprayed onto the block while it is inside the container, thereby gradually dissolving the exposed surface to form a concentrated solution. Such a dispenser system is, for instance, described in European patent application 244,153.

Solid detergent blocks have won a certain degree of popularity in the area of industrial warewashing because they constitute a non-dusty and therefore relatively safe product form for the often aggressive chemicals used. Furthermore, hydrated solid blocks are economical in use because they can be manufactured and transported as concentrated products.

However, elevated temperatures are required in the manufacturing process of the above-mentioned solid detergent blocks and these temperatures have an adverse effect on the stability of heat-labile components of the blocks.

In EP-A-375,022, an alternative type of detergent block is disclosed, namely a block of compressed granular material. This block constitutes an even more concentrated product and enables the incorporation of heat-labile components such as bleach compounds.

However, the quality of said compressed blocks was found to be inadequate if they were prepared from material substantially free of any phosphate builder.

We have now surprisingly found that compressed blocks of good quality but being substantially free of phosphate builder, can be produced by applying the process of the present invention.

In the context of the present invention, a good quality detergent block is defined as a block having a bulk density of 1200–2100 kg/m$^3$ and showing neither cracks in the block (lamination) nor at the top or bottom surface of the block (capping). Furthermore, a block which is substantially free of phosphate builder is defined as a block not containing more than 1% by weight of phosphorus.

DEFINITION OF THE INVENTION

According to the invention there is provided a process for preparing a block of compressed granular material being substantially free of a phosphate builder and having a weight of 0.2 to 10 kg, said process involving the steps of (i) granulating a non-phosphate builder material, with 0.1–10% by weight based on the weight of the builder of a co-ingredient selected from polycarboxylic polymer solutions, alkali metal silicate solutions, and mixtures thereof;

(ii) optionally, drying the thus-granulated builder material in a fluid bed to a free moisture content of less than 5% by weight, preferably less than 3% by weight; and (iii) compressing a particulate mixture of said granulated builder material and other components of the block, including a compressing aid, in a mould under a pressure of 3–30 kN/cm$^2$.

Another aspect of the invention is a solid detergent composition in the form of a block of a compressed granular material, said block having a weight of 0.2–10 kg, being substantially free of a phosphate builder and comprising:

(i) 15–70% by weight of a granulated builder material including a non-phosphate builder and 0.1–10% by weight based on the weight of said builder of a co-ingredient as defined herein;

(ii) 5–80% by weight of an alkaline agent;

(iii) 0.5–5% by weight of a compressing aid selected from nonionic surfactants, metal soaps, paraffins, talcum powder, polyethylene glycol, mixtures of ketones and fatty alcohols, and mixtures thereof;

(iv) 0–20% by weight of a bleaching agent.

DETAILED DESCRIPTION OF THE INVENTION

Using the process of the invention, physically stable detergent blocks having a porosity of at most 10% by volume and a bulk density of 1200–2100 kg/m$^3$, preferably 1500–1900 kg/m$^3$, can be prepared. For environmental reasons, said blocks do preferably not contain any phosphate builder.

The detergent blocks of the invention have a weight of 0.2–10 kg, preferably 1–5 kg. The blocks are usable for various applications in the area of industrial cleaning, such as mechanical warewashing and fabric washing, but other industrial detergent processes are also envisaged (e.g. bottle washing or conveyor belt lubricating). The blocks are particularly suitable for use in a mechanical ware washing process.

The detergent blocks of the invention generally contain detergent components usually found in material suitable for use in an industrial washing machine, such as a detergency builder, an alkaline agent, a bleaching agent and one or more types of foam-depressing and lubricating material.

The granulating step

During the granulation step, non-phosphate builder material is granulated with 0.1–10% by weight based on the weight of the builder of a co-ingredient selected from polycarboxylic polymer solutions, alkali metal silicate solutions, and mixtures thereof.

The granulation step is preferably carried out by dry-mixing the builder with the co-ingredient, desirably at room temperature. This may be effectively performed in a Loedige or Fukae type batch or continuous mixer. Alternatively, the builder material may be granulated by forming a slurry containing said builder and the co-ingredient and subsequently spray-drying the slurry. If needed, the thus obtained granulated builder material may be dried in a fluid bed to a free moisture content of less than 5% by weight, preferably less than 3% by weight (measured at 120° C.). It was observed that the compactibility of the particulate mixture used for preparing the detergent block of the invention could be improved by applying the above described drying step.

Suitable polycarboxylated polymers for use as co-ingredient are selected from the group consisting of homopolymers and copolymers of one or more of acrylic acid, methacrylic acid, maleic acid, acrylamide, itaconic acid, ($C_1$–$C_4$)-alkyl (meth)-acrylates or amides, alpha-chloroacrylic acid, alkyl-vinylether or vinylesthers. Most preferred polymers are selected from the group of homopolymers and copolymers of acrylic acid and maleic acid.

An alkali metal silicate solution is preferred for use as co-ingredient since this material can be used at much lower levels (i.e. 0.25–5%, preferably 0.5–3.0% by weight based on the weight of the non-phosphate builder) than the polycarboxylated polymer owing to its lower viscosity. The viscosity of the silicate solution is lower than 400 mPas at 20° C. whereas the viscosity of the polycarboxylated polymer solution is generally considerably higher. Preferably, sodium silicate containing silicium oxide and sodium oxide at a weight ratio in the range of 1.0–3.3, especially of 1.5–2.2, is applied.

The compressing aid is selected from nonionic surfactants, metal soaps, paraffins, talcum powder, polyethylene glycol, mixtures of ketones and fatty alcohols, and mixtures thereof. Preferred types of compressing aids are nonionic surfactants and mixtures of ketones and fatty alcohols. The compressing aid is present at a level of 0.5–5% by weight, preferably 1–3% by weight, based on the total weight of the detergent block.

After the above-described process steps, the granulated builder material is mixed with the other components of the detergent block including the compressing aid to form a particulate mixture. Subsequently, said mixture is compressed in a mould under a pressure of 3–30 kN/cm$^2$, preferably 3–15 kN/cm$^2$.

This compaction step can be carried out in a suitable press, preferably a hydraulic press, for instance a LAEIS Hydraulische Doppeldruckpresse, TYP HPF 630 as manufactured by LAEIS, West Germany.

Preferably, more than one compaction cycle is applied in order to maximise the block density and quality.

Builder material

Generally, the detergent block of the present invention contains from 15–70% by weight of a builder material granulated according to the process of the invention. As mentioned above, said granulated material includes a non-phosphate builder and a co-ingredient.

This non-phosphate builder material is preferably selected from the group consisting of sodium nitrilotriacetate, sodium citrate, phosphonates, aluminosilicates, polycarboxylates, layered silica, oxidised starch, polypeptides, oxidised heteropolymeric polysaccharides, salts of dipicolinic acid (DPA), ethylene diamine tetraacetic acid (EDTA), salts of terpolymers from acrylic acid, maleic acid and vinylacetate, 3 Na-salt of methylglycine diacetic acid. The most preferred types of non-phosphate builder material are sodium nitrilotriacetate, sodium citrate, and 3 Na-salt of methylglycine diacetic acid.

Alkaline material

Depending on the specific application, the detergent block of the invention contains, in addition to the above builder component, from 5–80% by weight, preferably from 10–70% by weight, of an alkaline agent, such as sodium- or potassium-hydroxide, -silicate, particularly -metasilicate, or -carbonate. Generally, compositions for use in a mechanical warewashing machine are most alkaline and contain the highest levels of these alkaline agents, which levels are suitably in the range of 20–70% by weight.

Bleaching agent

The detergent block of the invention may also comprise a bleach component, encapsulated or not, in an amount of up to 20% by weight. Said bleach component may be a hypohalite bleach such as NaDCCA, or a peroxygen compound, i.e. a compound capable of yielding hydrogen peroxide in aqueous solution.

For environmental reasons, a peroxygen compound selected from alkali metal peroxides, organic peroxides, such as urea peroxide, and inorganic persalts such as the alkali metal perborates, percarbonates, perphosphates, persilicates and persulphates, is preferably used. Mixtures of two or more of such compounds may also be suitable.

Particularly preferred are sodium perborate tetrahydrate and, especially, sodium perborate monohydrate. Sodium perborate monohydrate is preferred because of its high active oxygen content. Sodium percarbonate may also be preferred for environmental reasons.

The peroxygen bleach compound is suitably present in the detergent block of the invention at a level of up to 20% by weight, preferably of from 5 to 10% by weight. On the other hand, if present the hypohalite bleach may be suitably used in an amount of up to 5%, preferably 1–4% by weight, as active chlorine.

Organic peroxyacids may also be suitable as peroxygen bleaching agent. Such materials normally have the general formula:

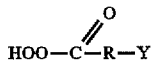

wherein R is an alkylene or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a COOH or

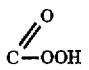

group or a quaternary ammonium group.

Typical monoperoxy acids useful herein include, for example:

(i) peroxybenzoic acid and ring-substituted peroxybenzoic acids, e.g. peroxy-α-naphthoic acid;

(ii) aliphatic, substituted aliphatic and arylalkyl monoperoxyacids, e.g. peroxylauric acid, peroxystearic acid and 6-(N-phthalimido)-peroxyhexanoic acid (PAP); and (iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxybrassilic acid; diperoxysebasic acid and diperoxyisophthalic acid;

(vii) 2-decyldiperoxybutane-1,4-diotic acid; and (viii) 4,4'-sulphonylbisperoxybenzoic acid.

Also inorganic peroxyacid compounds are suitable, such as for example potassium monopersulphate (MPS). If organic or inorganic peroxyacids are used as the peroxygen compound, the amount thereof will normally be within the range of about 2–10% by weight, preferably from 4–8% by weight.

All these peroxide compounds may be utilized alone or in conjunction with a peroxyacid bleach precursor and/or an organic bleach catalyst not containing a transition metal.

Peroxyacid bleach precursors are known and amply described in literature, such as in the British Patents 836988; 864,798; 907,356; 1,003,310 and 1,519,351; German Patent 3,337,921; EP-A-0185522; EP-A-0174132; EP-A-0120591; and U.S. Pat. Nos. 1,246,339; 3,332,882; 4,128,494; 4,412,934 and 4,675,393.

Another useful class of peroxyacid bleach precursors is that of the cationic i.e. quaternary ammonium substituted peroxyacid precursors as disclosed in U.S. Pat. Nos. 4,751,015 and 4,397,757, in EP-A0284292 and EP-A-331,229. Examples of peroxyacid bleach precursors of this class are:

2-(N,N,N-trimethyl ammonium) ethyl sodium-4-sulphonphenyl carbonate chloride—(SPCC);

N-octyl,N,N-dimehyl-$N_{10}$-carbophenoxy decyl ammonium chloride —(ODC);

3-(N,N,N-trimethyl ammonium) propyl sodium-4-sulphophenyl carboxylate; and

N,N,N-trimethyl ammonium toluyloxy benzene sulphonate.

A further special class of bleach precursors is formed by the cationic nitriles as disclosed in EP-A-303,520 and in European Patent Specification No.'s 458,396 and 464,880.

Any one of these peroxyacid bleach precursors can be used in the present invention, though some may be more preferred than others.

Of the above classes of bleach precursors, the preferred classes are the esters, including acyl phenol sulphonates and acyl alkyl phenol sulphonates; the acyl-amides; and the quaternary ammonium substituted peroxyacid precursors including the cationic nitriles.

Examples of said preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoloxy benzoate; SPCC; trimethyl ammonium toluyloxy-benzene sulphonate; sodium nonanoyloxybenzene sulphonate (SNOBS); sodium 3,5,5-trimethyl hexanoyloxybenzene sulphonate (STHOBS); and the substituted cationic nitriles.

The precursors may be used in an amount of up to 12%, preferably from 2–10% by weight, of the composition. Organic bleach catalyst most suitable for being utilized here are the so-called sulphonimides as disclosed in EP-A-0453003 and EP-A-0446982.

Antiscaling agent

The detergent block of the invention preferably also comprises up to 25% by weight of an anti-scaling agent, consisting of a polycarboxylated polymer and a carrier material therefore. The concentration of said polymer in said anti-scaling agent is preferably in the range of from 20 to 50% by weight as calculated on the total weight of the anti-scaling agent. When present, the anti-scaling agent is, preferably, substantially homogeneously mixed throughout the detergent block of the invention.

Suitable polymer materials for this anti-scaling agent may be the same as those of which the solution is suitable for use as co-ingredient in the granulating step of the present invention.

Suitable inorganic carrier materials are selected from the group consisting of sulphates, carbonates, silicates, aluminosilicates, percarbonates, perborates, clays, and mixtures thereof. Most preferred carrier material is selected from silicates, carbonates, and mixtures thereof.

The detergent block of the invention may further comprise suitable minor ingredients, such as bleach stabilizers, enzymes, etc.

The invention is illustrated by the following non-limiting Examples, in which parts and percentages are by weight unless otherwise stated.

In the Examples, the following abbreviations are used:

Trilon A92: sodium nitrilotriacetate containing 1 mole of water (laq), ex BASF;

Norasol WL2-Si: 40% polyacrylate (mol wt 4500) on 30% sodium silicate ($SiO_2$:$Na_2O$=2) and 30% sodium carbonate, ex NorsoHaas Perborate mono: sodium perborate monohydrate, ex Atochem Caustic : sodium hydroxide micropearls, ex Solvay;

Dehypon 2429 : mixture of ketones in fatty alcohol, ex Henkel;

Dequest 2047 : calcium salt of ethylene diamine tetra methylene phosphonic acid, ex Monsanto;

Crystal-112 : 45% alkaline silicate solution, ex Crosfield;

Norasol LMW-45N: 40% solution of sodium polyacrylate (mol wt: 4500) in water, ex NorsoHaas.

EXAMPLE 1, COMPARATIVE EXAMPLE A

In a Lödige-type mixer, 25 parts of Norasol WL-2Si were sprayed upon with 2 parts of Dehypon 2429. The resultant material was mixed with the following ingredients:

| Example no. | 1 (parts) | A (parts) |
|---|---|---|
| Dequest 2047 | 0.5 | 0.5 |
| Perborate mono | 7.0 | 7.0 |
| Caustic | 50.0 | 50.0 |
| Sprayed Trilon A92 | — | 15.5 |
| NTA-granules | 15.5 | — |

Said NTA-granules (NTA: sodium nitrilotriacetate) were made by granulating 94.96 parts of Trilon A92 with 2.16 parts of Crystal-112 and subsequently spraying said granulated material with 2.88 parts of Dehypon 2429. The moisture content of these NTA-granules as measured before the spraying step was 1.9% by weight.

The sprayed Trilon A92 shown in the composition of Example A, was made by spraying 97.12 parts of of Trilon A92 with 2.88 parts of Dehypon 2429.

In both cases, the resulting powder was compressed to 3 kg blocks (having a density of 1710 kg/m$^3$) in a mould under a pressure of 12 kN/cm$^2$ using a double punch press.

The blocks prepared by compressing the powder of Example 1 were of good quality/stability and did not show any sign of lamination or capping. On, the other hand, the blocks prepared by compressing the powder of comparative Example A showed both capping and lamination phenomena and were not physically stable.

EXAMPLE 2, COMPARATIVE EXAMPLE B

Powder-form mixtures having the following compositions were obtained by mixing the components in a L ōdige-type mixer:

| Example no. | 2 (parts) | B (parts) |
|---|---|---|
| Dequest 2047 | 0.35 | 0.35 |
| Perborate mono | 7.0 | 7.0 |
| Caustic | 48.0 | 48.0 |
| Sprayed Trilon A-92 | — | 35.0 |
| Norasol WL-2Si | 12.5 | 12.5 |
| NTA-granules | 35.75 | — |

Said NTA-granules were previously prepared by granulating 33.0 parts of Trilon A92 with 0.75 parts of Crystal-112, and subsequently spraying the thus-prepared granulated material with 2.0 parts of Dehypon 2429. The moisture content of these NTA-granules as measured before the spraying step, was 1.9% by weight.

The sprayed Trilon A92 shown in the composition of Example B, was made by spraying 33.0 parts of of Trilon A92 with 2.0 parts of Dehypon 2429.

In both cases, the resulting powder was compressed to 3 kg blocks (having a density of 1680 kg/m$^3$) in a mould under a pressure of 12 kN/cm$^2$ using a double punch press.

Similarly as in Examples 1 and A, the blocks prepared by compressing the powder of Example 2 showed good quality and stability, whereas the blocks obtained from the powder of Example B showed capping and lamination and were physically not stable.

It can be concluded that both at low and high levels of NTA, pregranulation of NTA results in significant improvement of the quality and stability of the detergent blocks obtained.

EXAMPLE 3, COMPARATIVE EXAMPLE C

In a Lōdige type mixer, two types of NTA-granules (indicated as NTA-granules (1) and NTA-granules (2)) were prepared by granulating 33 parts of Trilon A92 with 1.67 parts respectively 2.78 parts of Norasol LMW 45N. The moisture content of NTA-granules (1) is 3.41% by weight and of NTA-granules (2) is 5.01% by weight.

On to these NTA-granules, 2 parts of Dehypon 2429 was sprayed. Immediately thereafter, the resultant material was mixed with the other ingredients as given below to obtain the following formulations:

| Example no. | 3 (parts) | C (parts) |
|---|---|---|
| NTA-granules (1) | 34.67 | — |
| NTA-granules (2) | — | 35.78 |
| Dehypon 2429 | 2.00 | 2.00 |
| Dequest 2047 | 0.25 | 0.25 |
| Perborate mono | 7.00 | 7.00 |
| Caustic | 47.75 | 47.75 |
| Norasol WL-2-Si | 10.63 | 9.38 |

In both cases, the resulting powder was compressed to 3 kg blocks (having a density of 1670 kg/m$^3$) in a mould under a pressure of 12 kN/cm$^2$ using a double punch press.

The blocks prepared by compressing the powder of Example 3 showed good quality and stability, whereas the blocks obtained from the powder of Example C showed lamination and were physically not stable.

It can be concluded that, when applying NTA-granules with low moisture content, detergent blocks are obtained having significantly improved quality and stability.

We claim:

1. A process for preparing a block of compressed granulates having no more than 1% by weight of a phosphorus and having a weight of 0.2 to 10 kg, the process comprising the steps of:

i) granulating a non-phosphate builder selected from the group consisting of sodium nitrilotriacetate, sodium citrate and 3-sodium salt of methyl glycine diacetic acid with 0.1 to 10%, by weight based on the weight of the non-phosphate builder, of a co-ingredient selected from polycarboxylic polymer salt solutions, alkaline metal silicate solutions, and mixtures thereof to form builder granulates;

ii) drying the builder granulates to a moisture content of less than 5% by weight; and iii) compressing the builder granulates with a mixture of ketones and fatty alcohols as a compressing aid, in a mould under a pressure of 3–30 kN/cm$^2$ to form a particulate mixture in the form of a block.

2. The process according to claim 1, wherein said granulating step is carried out by dry-mixing the builder with the co-ingredient.

3. The process according to claim 1, wherein said granulating step is carried out by forming a slurry containing the builder and the co-ingredient and subsequently spray-drying the slurry.

4. The process according to claim 1, wherein said granulation step is carried out with an alkali metal silicate solution containing a silicate having a silicium oxide to sodium oxide weight ratio of 1.0–3.3, as a co-ingredient.

5. The process according to claim 4 wherein the silicate of the granulation step has a silicium oxide to sodium oxide weight ratio of 1.5 to 2.2.

6. The process according to claim 1, wherein the particulate mixture is compressed under a pressure of 3–15 kN/cm$^2$.

* * * * *